US005264824A

United States Patent [19]

Hour

[11] Patent Number: 5,264,824

[45] Date of Patent: Nov. 23, 1993

[54] AUDIO EMITTING TREAD MAT SYSTEM

[76] Inventor: Jin-Rong Hour, No. 51-50, Alley 85, Lane 673, Chung-Cheng Road, Jen-Te Hsiang, Tainan Hsien, Taiwan

[21] Appl. No.: 871,712

[22] Filed: Apr. 21, 1992

[51] Int. Cl.[5] ..... G08B 3/00; G08B 21/00

[52] U.S. Cl. ..... 340/384 E; 340/665; 340/666; 340/692; 340/330; 200/85 R; 200/86.5

[58] Field of Search ..... 340/384 E, 384 R, 665, 340/666, 667, 573, 591, 692, 328-330; 200/85 R, 86.5

[56] References Cited

U.S. PATENT DOCUMENTS 2,780,693 2/1957 McClellan ..... 340/666
2,783,327 2/1957 Luckey ..... 340/666
3,604,958 9/1971 Palini ..... 340/665
3,991,415 11/1976 Baar, Sr. ..... 340/666
4,172,216 10/1979 O'Shea ..... 340/666
4,359,726 11/1982 Lewiner et al. ..... 340/666

*Primary Examiner*—Donnie L. Crosland
*Attorney, Agent, or Firm*—Morton J. Rosenberg; David I. Klein

[57] ABSTRACT

A sound-giving tread mat has a bag-like tread mat, a foam rubber sheet interposed in the tread mat, one or more buzzers partly adhered on the inner surface of the lower layer of the tread mat, and a sound-giving electric unit to give out sounds. The buzzer(s) is electrically connected with the sound-giving unit placed on a corner surface of the tread mat or somewhere inside a door in a house. When the tread mat is treaded on with a shoe of a visitor, the buzzer(s) can be vibrated by the compressed air in the tread mat to give out an electric signal, and then the sound-giving electric unit amplifies the electric signal coming from the buzzer(s) and gives out sounds.

1 Claim, 6 Drawing Sheets

AUDIO EMITTING TREAD MAT SYSTEM

BACKGROUND OF THE INVENTION

A conventional audio emitting tread mat is shown in FIG. 7 and comprises a tread mat 1, two sheets of insulating papers 2 having conductive printing carbon powder 21 adhered to its top and bottom surfaces. A foam rubber sheet 3 having a predetermined thickness includes a plurality of holes 31 and a sound device 4 which are combined into the structure. The foam rubber sheet 3 is sandwiched between the two sheets of the insulating papers 2 and two lead wires 211, 211' are respectively connected between the top and the bottom layer of the carbon powder 21 and the input of the sound device 4.

When the tread mat 1 is stepped on by a person, the foam rubber sheet 3 is compressed, forcing the top layer and the bottom layer of carbon powder 21 to contact each other so that the sound device 4 is powered to emit sounds announcing that a visitor has arrived.

The conventional audio emitting tread mat described above is considered to have the following disadvantages:

1. The total amount of components are large in number which increases assembling work and costs;
2. The lead wires cannot be connected with the layers of carbon powder by means of simple welding, but must be secured by gum tape which is easily releasable; and,
3. The insertion of insulating paper in the tread mat is difficult since it folds.

SUMMARY OF THE INVENTION

The audio emitting tread mat of the present invention has been improved to include the following features:

1. One or more air actuated transducers are first adhered on an inner surface of the bottom layer of the tread mat and then a foam rubber sheet is interposed in the tread mat to minimize assembly work and time;
2. Carbon powder used in conventional audio emitting tread mats is not used to allow secured electrical coupling;
3. Insulating paper used in conventional audio emitting tread mats is not used to provide a system independent of folding criteria;
4. The sound device can be located in a displaced manner from the tread mat inside a house; and,
5. A small insulating member is provided to be inserted in the sound device to temporarily disable the sound device during the evening.

BRIEF DESCRIPTION OF THE DRAWINGS

FIG. 5 is a schematic view of compressed air transmitting vibration in the audio emitting tread mat when treaded on;

DETAILED DESCRIPTION OF THE PREFERRED EMBODIMENTS

Figure 1:
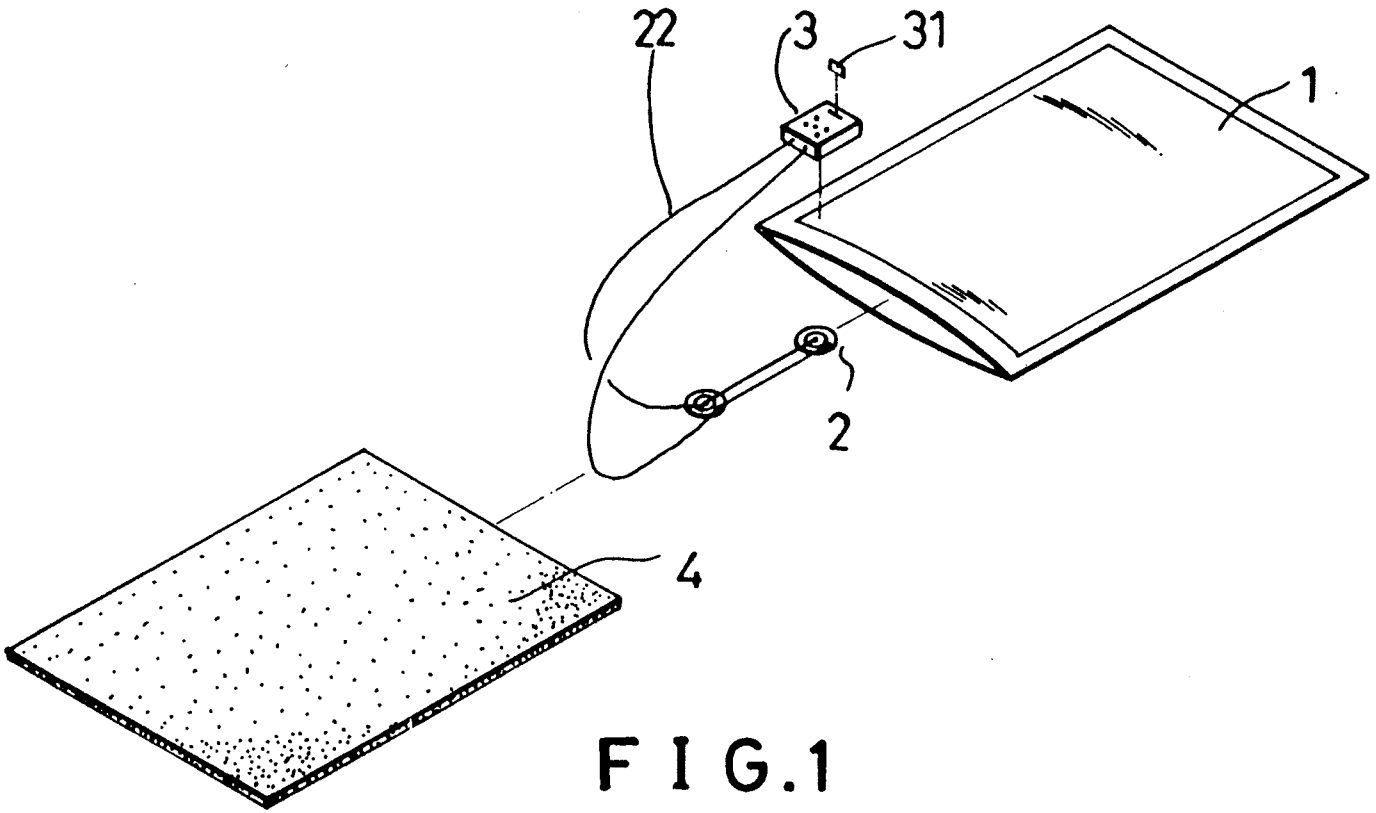
FIG. 1 is an exploded perspective view of the audio emitting tread mat of the present invention.

The audio emitting tread mat 1 of the present invention, as shown in FIG. 1, comprises a tread mat 1, one or more air pressure actuated transducers 2, sound device 3, and a foam rubber sheet 4 as its main components.

The tread mat 1 is shaped as a substantially enclosed bag and has an opening formed through one end which is sewn together and defines a small hole 11 for passage of lead wires 22 extending from the interior of the tread mat 1.

The air pressure actuated transducer 2 is a thin circular metal disk having a smaller diametrical insulated portion than its body and is adhered to the inner surface of the lower layer of the tread mat 1. A gap 21 is provided between the air pressure actuated transducer 2 and the inner surface of the lower layer of the tread mat 1. Two lead wires 22 are connected between the air pressure actuated transducer 2 and the sound device 3, which pass through the small hole 11 in the sewn opening of the tread mat 1. The sound device 3 is an electrical device for emitting musical sounds and is located at a corner of the outer surface of the tread mat 1. A small thin electrically insulating member 31 is provided for insert in the sound device 3 to electrically decouple the battery for temporarily disabling the sound device 3. The foam rubber sheet 4 is soft and has a predetermined thickness to elastically recover a pre-loading thickness after compression by a shoe of a person treading on the mat.

Figure 2:
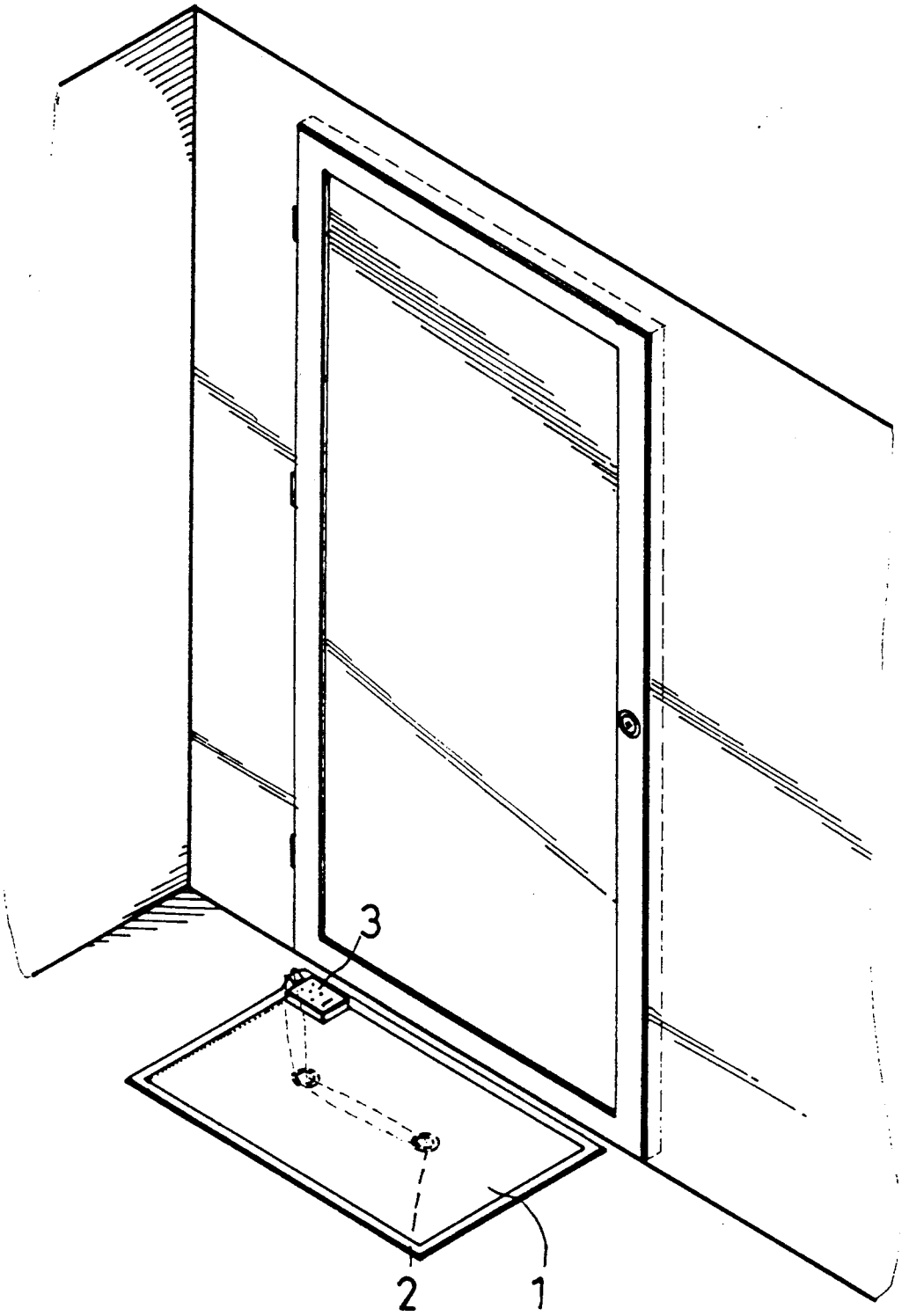
FIG. 2 is a perspective view of the audio emitting tread mat of the present invention.

In assembling this tread mat, as shown in FIGS. 1 and 2, one or more air pressure actuated transducers 2 are welded to the lead wires 22 and then directly adhered to the inner surface of the lower layer of the tread mat 1 leaving an air gap 21 between the middle portion of the air pressure actuated transducer 2 and the lower layer of the tread mat 1. The foam rubber sheet 4 is interposed in the tread mat 1 on the air pressure actuated transducer 2 and the opening of the tread mat 1 is sewn together leaving the small hole 11 for the lead wires 22 to pass therethrough to be connected to input terminals of the sound device 3.

Figure 3:
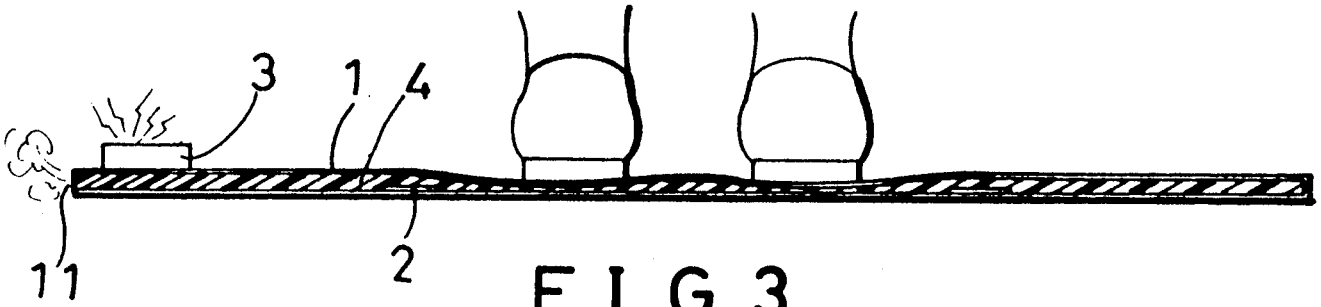
FIG. 3 is a side view of the audio emitting tread mat of the present invention.
Figure 4:
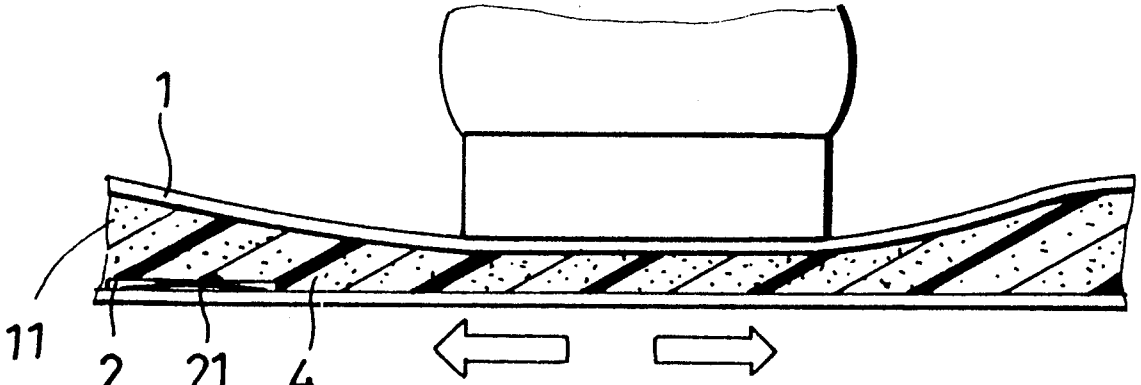
FIG. 4 is a magnified side view of the audio emitting tread mat treaded on by a shoe.
Figure 5:
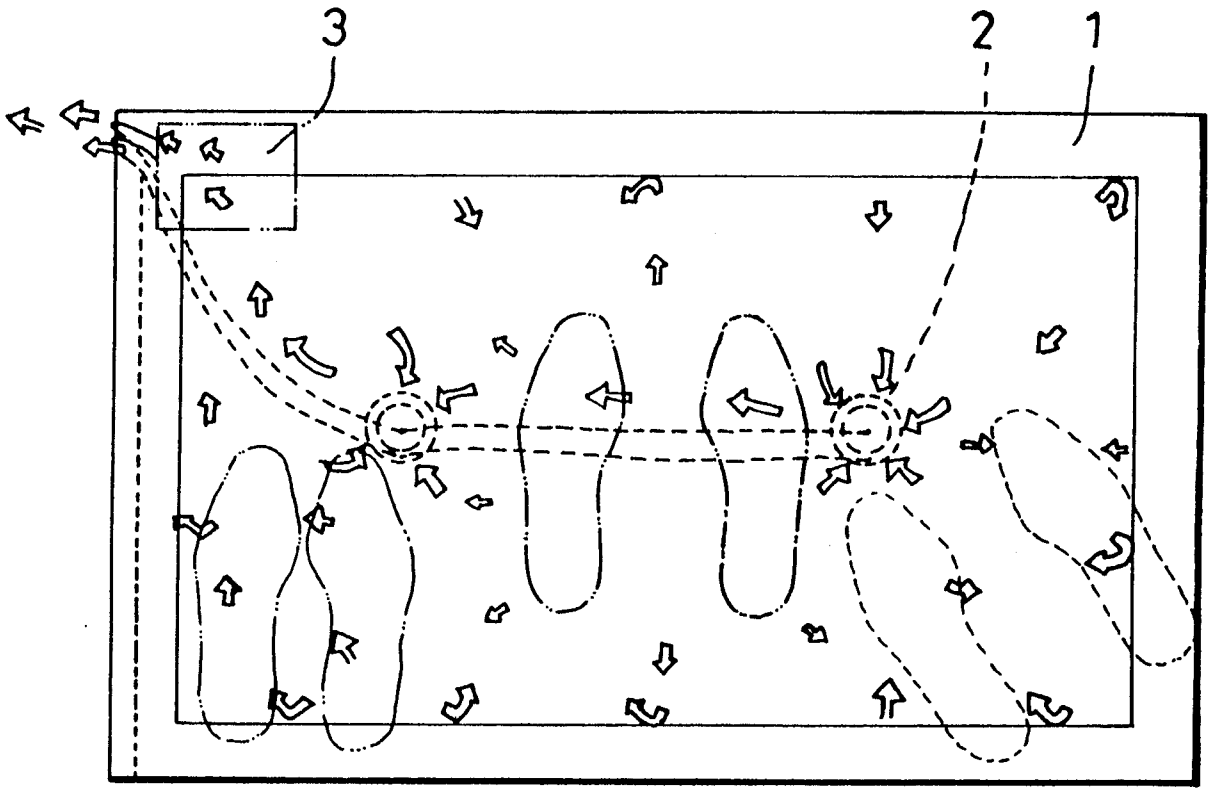
Figure 6:
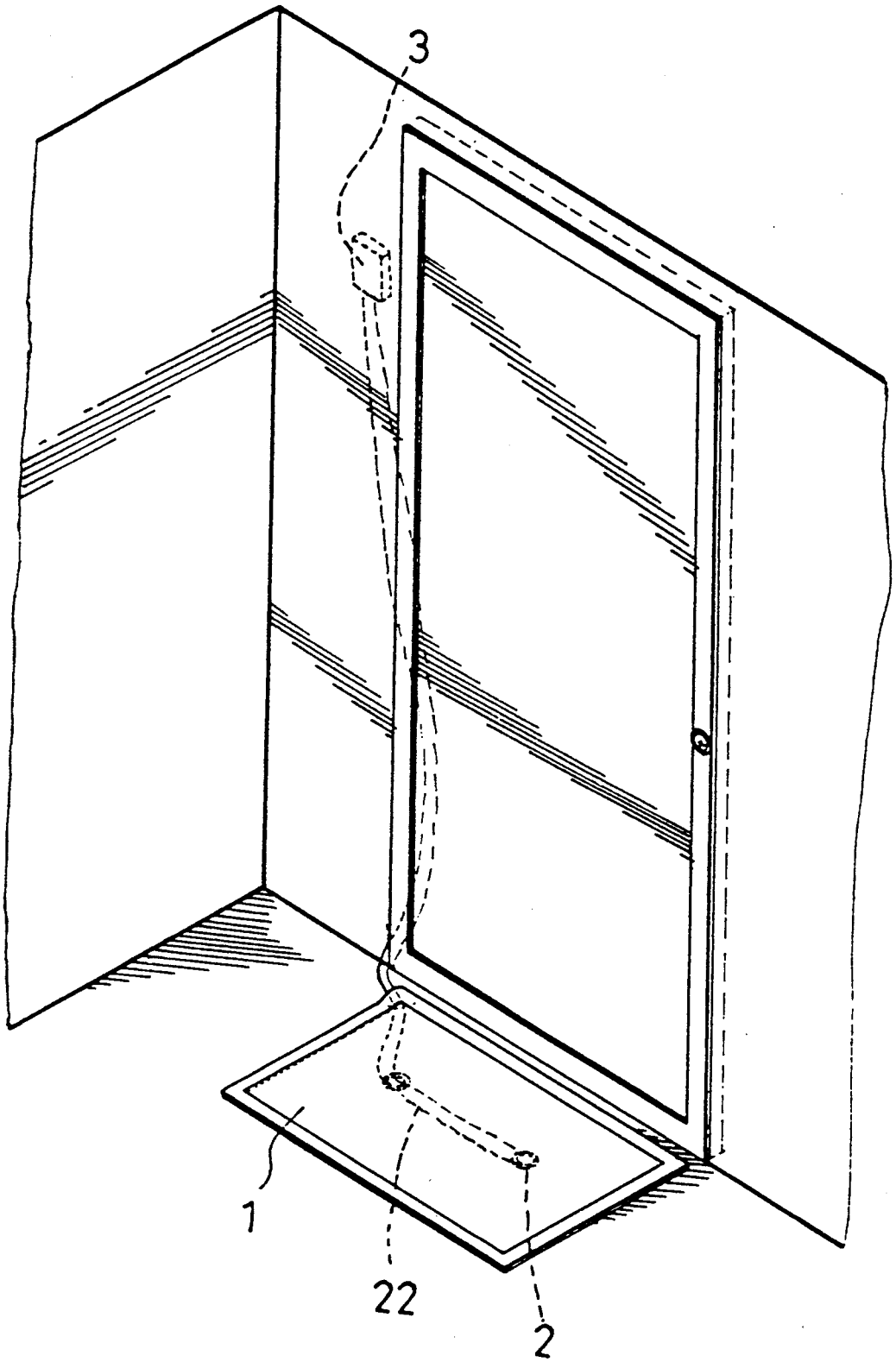
FIG. 6 is a perspective view of another embodiment of the audio emitting tread mat of the present invention; and, FIG. 7 is an exploded perspective view of a prior art emitting tread mat.
Figure 7:
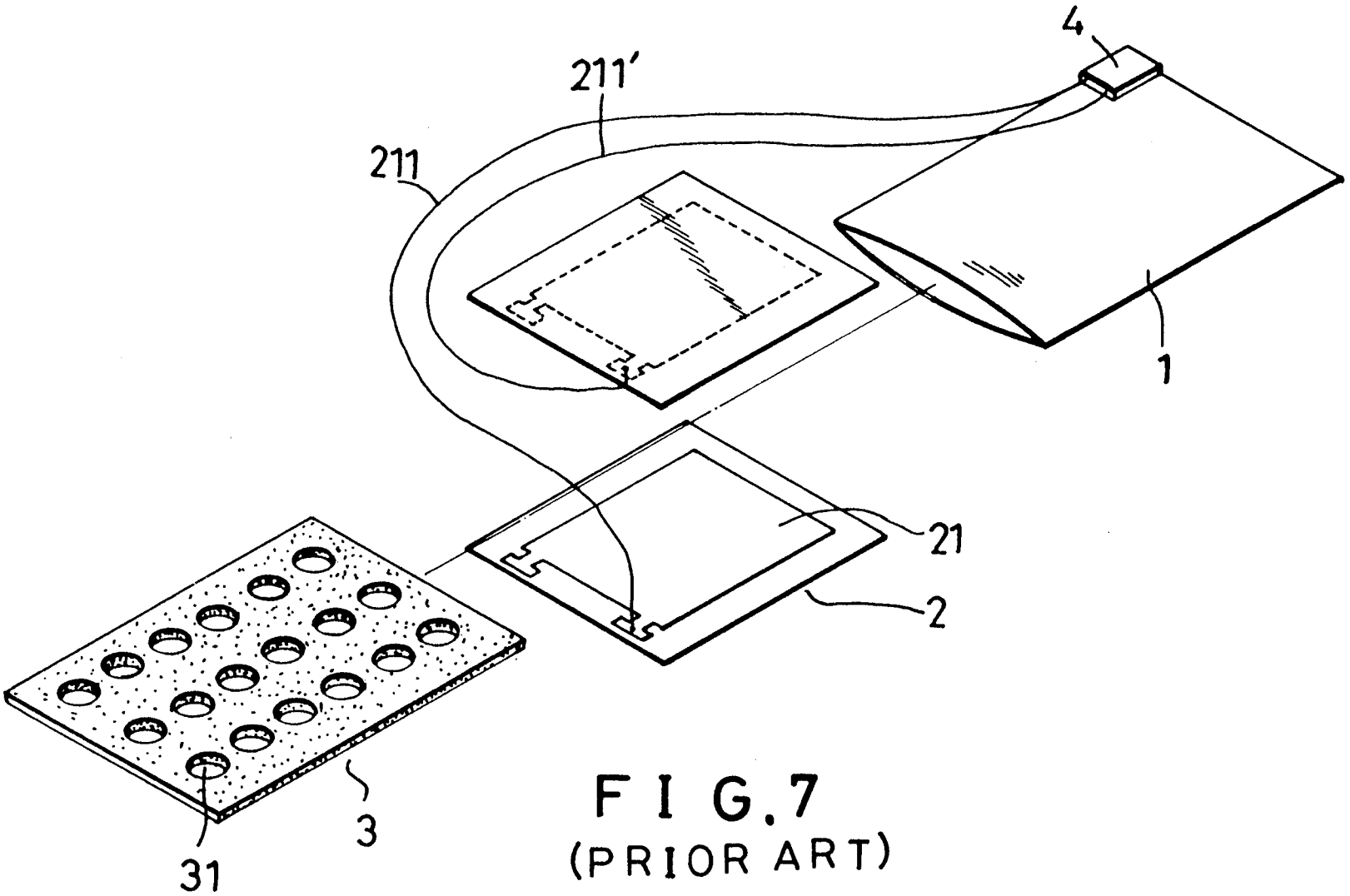
FIG. 7 (PRIOR ART)

When a person steps on the tread mat 1 placed outside the door of a house, as shown in FIGS. 3 and 4, the surface of the tread mat 1 is pressed down by the loading criteria so that the foam rubber sheet 4 is compressed to force air in the tread mat 1 to flow out of the small hole 11. Simultaneously, the air pressure inside the tread mat becomes uneven or transient, giving rise to an air pressure transmitting vibration as shown in FIG. 5. As the air pressure actuated transducer 2 has the air gap 21, the air pressure actuated transducer 2 vibrates responsive to the air pressure transmitting vibration which generates an electrical signal. The signal is transmitted through the lead wires 22 to the sound device 3 which amplifies the sound to emit sounds announcing a visitor.

The sound device 3 can be fixed inside a door instead of the corner surface of the mat 1 and the lead wires 22 can be located in a tube connecting the sound device 3 and the tread mat 1 placed outside the door. In this placement, the sounds emitted by the sound device 3 will not annoy neighboring residents. During the evening, the thin insulating member 31 can be inserted in the sound device unit 3. This procedure decouples the battery in the sound device 3 to electrically decouple the power source so that the device 3 does not emit sounds. Removing the member 31 recovers the function of the sound device 3.

While the preferred embodiments of the invention have been described above, it will be recognized and understood that various modifications may be made therein, and the appended claims are intended to cover all such modifications which may fall within the spirit and scope of the invention.

What is claimed is:

1. An audio emitting tread mat system comprising:

(a) a substantially enclosed bag-shaped tread mat having at least one opening formed therethrough for passage of at least a pair of lead wires;

(b) a foam rubber sheet located within said substantially enclosed bag-shaped tread mat;

(c) at least one pressure actuated transducer positionally located between a lower surface of said foam rubber sheet and an inner surface of said bag-shaped tread mat;

(d) a sound device located on an outer surface of said bag-shaped tread mat coupled to said air pressure actuated transducer by said lead wires, said foam rubber sheet being compressibly displaceable for increasing pressure transient within said bag-shaped tread mat allowing air to pass external to said tread mat through said opening and simultaneously actuating said air pressure actuated transducer for developing an electrical signal applied to said sound device through said lead wires, said air pressure actuated transducer being located within a recess formed within said lower surface of said foam rubber sheet providing an air gap between said inner surface of said tread mat and said air pressure actuated transducer for receiving vibrations of said compressed air responsive to a loading force applied to said foam rubber sheet.

* * * * *